US010808200B2

(12) United States Patent
Nakashima et al.

(10) Patent No.: US 10,808,200 B2
(45) Date of Patent: Oct. 20, 2020

(54) LIQUID COMPOSITION AND TERMINAL-FITTED ELECTRIC WIRE

(71) Applicants: AUTONETWORKS TECHNOLOGIES, LTD., Yokkaichi, Mie (JP); KYUSHU UNIVERSITY, Fukuoka-shi, Fukuoka (JP)

(72) Inventors: Kazuo Nakashima, Mie (JP); Takehiro Hosokawa, Mie (JP); Tatsuya Hase, Mie (JP); Hironobu Rachi, Mie (JP); Hiroki Hirai, Mie (JP); Junichi Ono, Mie (JP); Takuji Ootsuka, Mie (JP); Hideki Nomura, Mie (JP); Makoto Mizoguchi, Fukuoka (JP)

(73) Assignees: AUTONETWORKS TECHNOLOGIES, LTD., Yokkaichi, Mie (JP); KYUSHU UNIVERSITY, Fukuoka-Shi (JP)

( * ) Notice: Subject to any disclaimer, the term of this patent is extended or adjusted under 35 U.S.C. 154(b) by 0 days.

(21) Appl. No.: 15/574,937

(22) PCT Filed: May 11, 2016

(86) PCT No.: PCT/JP2016/064023
§ 371 (c)(1),
(2) Date: Nov. 17, 2017

(87) PCT Pub. No.: WO2016/190109
PCT Pub. Date: Dec. 1, 2016

(65) Prior Publication Data

US 2018/0163154 A1 Jun. 14, 2018

(30) Foreign Application Priority Data

May 25, 2015 (JP) ..... 2015-105660

(51) Int. Cl.

| | |
|---|---|
| ***C23F 11/00*** | (2006.01) |
| ***C10M 169/00*** | (2006.01) |
| ***C10M 127/02*** | (2006.01) |
| ***C10M 101/02*** | (2006.01) |
| ***C10M 169/02*** | (2006.01) |

(Continued)

(52) U.S. Cl.

CPC ..... *C10M 169/00* (2013.01); *C10M 101/02* (2013.01); *C10M 127/02* (2013.01); *C10M 129/16* (2013.01); *C10M 129/24* (2013.01); *C10M 129/68* (2013.01); *C10M 129/70* (2013.01); *C10M 131/04* (2013.01); *C10M 137/06* (2013.01); *C10M 139/00* (2013.01); *C10M 141/12* (2013.01); *C10M 169/02* (2013.01); *H01B 7/2806* (2013.01); *H01R 11/11* (2013.01); *C10M 2203/022* (2013.01); *C10M 2207/04* (2013.01); *C10M 2207/08* (2013.01); *C10M 2207/28* (2013.01); *C10M 2207/281* (2013.01); *C10M 2211/00* (2013.01); *C10M 2223/04* (2013.01); *C10M 2227/06* (2013.01); *C10N 2010/02* (2013.01); *C10N 2010/04* (2013.01); *C10N 2010/06* (2013.01); *C10N 2010/08* (2013.01); *C10N 2020/02* (2013.01); *C10N 2020/069* (2020.05); *C10N 2020/071* (2020.05); *C10N 2030/12* (2013.01); *C10N 2040/14* (2013.01); *C10N 2040/32* (2013.01); *C10N 2050/10* (2013.01); *H01R 4/185* (2013.01); *H01R 4/70* (2013.01); *H01R 13/5216* (2013.01)

(58) Field of Classification Search

CPC ..... C10M 2205/0285; C10M 163/00; C10M 2223/04; C10M 161/00; C10M 2201/085; C10M 101/00; C10M 2203/00; C10M 2290/00; C10M 2290/02; C10M 2290/026; C10M 2290/04; C10M 2290/10; C10M 2207/00; C09K 21/12; C23F 11/00

See application file for complete search history.

(56) References Cited

U.S. PATENT DOCUMENTS

| | | | | |
|---|---|---|---|---|
| 2006/0011256 | A1 | 1/2006 | Liu | |
| 2006/0111256 | A1* | 5/2006 | Kinoshita | C10M 169/06 508/552 |
| 2015/0141305 | A1* | 5/2015 | Onumata | C10M 169/045 508/192 |

FOREIGN PATENT DOCUMENTS

| | | | |
|---|---|---|---|
| CN | 102242008 | A | 11/2011 |
| JP | 2001089784 | A | 4/2001 |

(Continued)

OTHER PUBLICATIONS

International Search Report for Application No. PCT/JP2016/064023 dated Aug. 2, 2016; 7 pages.

(Continued)

*Primary Examiner* — Haidung D Nguyen
(74) *Attorney, Agent, or Firm* — Reising Ethington, P.C.

(57) ABSTRACT

A liquid composition which has an excellent coating property at room temperature and is retained on a surface to be coated after application on the surface, and a terminal-fitted electric wire having an increased corrosion resistance using the same. The liquid composition contains a high-consistency material, a low-viscosity liquid having a kinetic viscosity of 100 $mm^2/s$ or lower measured at 40° C. in accordance with JIS K2283, and an adduct containing an acidic phosphate ester containing one or more kinds of compounds represented by General Formulae (1) and (2), and a metal, $$P(=O)(-OR_1)(-OH)_2 \quad (1),$$

$$P(=O)(-OR_1)_2(-OH) \quad (2),$$

where $R_1$ represents a hydrocarbon group having 4 to 30 carbon atoms.

14 Claims, 2 Drawing Sheets

(51) Int. Cl.

| | |
|---|---|
| ***C10M 131/04*** | (2006.01) |
| ***C10M 129/16*** | (2006.01) |
| ***C10M 137/06*** | (2006.01) |
| ***C10M 129/68*** | (2006.01) |
| ***C10M 129/24*** | (2006.01) |
| ***H01B 7/28*** | (2006.01) |
| ***C10M 129/70*** | (2006.01) |
| ***C10M 139/00*** | (2006.01) |
| ***C10M 141/12*** | (2006.01) |
| ***H01R 11/11*** | (2006.01) |
| *H01R 13/52* | (2006.01) |
| *C10N 10/02* | (2006.01) |
| *C10N 10/04* | (2006.01) |
| *C10N 10/06* | (2006.01) |
| *C10N 10/08* | (2006.01) |
| *C10N 20/02* | (2006.01) |
| *C10N 20/00* | (2006.01) |
| *C10N 30/12* | (2006.01) |
| *C10N 40/14* | (2006.01) |
| *C10N 40/32* | (2006.01) |
| *C10N 50/10* | (2006.01) |
| *H01R 4/18* | (2006.01) |
| *H01R 4/70* | (2006.01) |

(56) References Cited

FOREIGN PATENT DOCUMENTS

| | | | | |
|---|---|---|---|---|
| JP | 2004059604 | A | 2/2004 | |
| JP | 2008239847 | A | 10/2008 | |
| JP | 2013060541 | A | 4/2013 | |
| WO | WO-2009153938 | A1 * | 12/2009 | ..... C10M 169/04 |

OTHER PUBLICATIONS

Chinese Office Action for Application No. 201680027227.2, dated Nov. 27, 2019; 9 pages.

English Translation for Chinese Office Action for Application No. 201680027227.2, dated Nov. 27, 2019; 9 pages.

Research status and development trend of oil soluble corrosion inhibitor used in antitrust oil of the metal, dated Jul. 2014; vol. 22 7 pages.

Office action issued by the China National Intellectual Property Administration for Application 201620027227.2 dated Apr. 28, 2020; 6 pages.

English translation of the Office action issued by the China National Intellectual Property Administration for Application 201620027227.2 dated Apr. 28, 2020; 7 pages.

* cited by examiner

LIQUID COMPOSITION AND TERMINAL-FITTED ELECTRIC WIRE

CROSS REFERENCE TO RELATED APPLICATIONS

This application claims the priority of Japanese patent application JP2015-105660 filed on May 25, 2015, the entire contents of which are incorporated herein.

TECHNICAL FIELD

The present invention relates to a liquid composition and a terminal-fitted electric wire, and more specifically to a liquid composition excellent in coating property and a terminal-fitted electric wire which is anti-corrosion-treated with ingredients contained in the liquid composition.

BACKGROUND ART

For a variety of metal devices and metal parts, surface coating agents are used for the purpose of lubrication and corrosion protection. Grease and the like are known as this type of surface coating agents. Patent Document 1 (JPA2013-60541) discloses a lubricant composition in which 30 to 70 mass % of isoparaffin solvent is added to a grease which contains a liquid paraffin as a base oil, an aluminum complex soap as a thickening agent, polyisobutylene as a viscosity enhancing agent, and sorbitan monooleate as a rust inhibitor.

SUMMARY

Since a grease has high consistency at room temperature, it is difficult to thinly and uniformly apply the grease on a surface to be coated. Since the viscosity of the grease can be reduced by heating, the grease may be thinly and uniformly applied on the surface to be coated by heating. However, there is a possible concern of thermal influence on a material to be coated. A grease contains a thickening agent, and thus fluidity of the grease is suppressed by network structure of the thickening agent. Thus, when a solvent with high fluidity and the like are added to the grease, the solvent added is simply captured in the network structure of the thickening agent in the grease, unlike in the case where the solvent is added to a single compound such as wax and Vaseline. Accordingly, it is difficult to increase fluidity of the grease by adding the solvent to the grease.

It is an object of the present application to provide a liquid composition which has an excellent coating property at room temperature and is retained on the surface to be coated after application to the surface, and a terminal-fitted electric wire whose corrosion resistance is increased by the liquid composition.

In order to solve the foregoing problem, the liquid composition according to the present invention contains a high-consistency material, a low-viscosity liquid having a kinetic viscosity of 100 $mm^2/s$ or lower measured at 40° C. in accordance with JIS K2283, and an adduct containing an acidic phosphate ester containing one or more kinds of compounds represented by General Formulae (1) and (2) and a metal, $$P(=O)(-OR_1)(-OH)_2 \quad (1)$$

$$P(=O)(-OR_1)_2(-OH) \quad (2),$$

where $R_1$ represents a hydrocarbon group having 4 to 30 carbon atoms.

In the liquid composition according to the present application, the high-consistency material is preferably a grease containing a base oil and a thickening agent. The low-viscosity liquid is preferably a volatile low-viscosity liquid having volatility. The low-viscosity liquid is preferably at least one kind selected from a hydrocarbon organic solvent, an ester organic solvent, an ether organic solvent, a ketone organic solvent, a halogenated hydrocarbon organic solvent, and a volatile oil. The content of the low-viscosity liquid is preferably within a range of 10 to 90 mass %.

In the liquid composition according to the present application, it is preferable that $R_1$ have one or more branched chain structures, or one or more carbon-carbon double bond structures in the structure of the hydrocarbon group having 4 to 30 carbon atoms. It is preferable that the metal that forms the adduct with the acidic phosphate ester be at least one metal selected from the group consisting of an alkali metals, an alkaline earth metals, aluminum, titanium, and zinc. The adduct containing the acidic phosphate ester and the metal preferably has a molecular weight of 3000 or lower. The ratio of the high-consistency material and the adduct containing the acidic phosphate ester and the metal is preferably within a range of 98:2 to 30:70.

It is preferable that the liquid composition according to the present application have a pH of four or higher. Furthermore, it is preferable that the composition form a high-consistency film on a metal surface when applied on the surface, and the film contains the high-consistency material and the adduct containing the acidic phosphate ester and the metal.

A terminal-fitted electric wire according to the present application contains an electric connecting section between a terminal metal fitting and an electric wire conductor, and the electric connecting section is covered with a high-consistency film, which contains the high-consistency material and the adduct containing the acidic phosphate ester and the metal, the high-consistency material and the adduct contained in the above-described liquid composition.

Since the liquid composition according to the present application contains the high-consistency material, the low-viscosity liquid having a kinetic viscosity of 100 $mm^2/s$ or lower measured at 40° C. in accordance with JIS K2283, and the adduct containing the acidic phosphate ester and the metal, the liquid composition has an excellent coating property at room temperature and can be retained on a surface to be coated after application to the surface.

In the liquid composition according to the present application, since $R_1$ has one or more branched chain structures, or one or more carbon-carbon double bond structures in the structure of the hydrocarbon group having 4 to 30 carbon atoms, the compatibility of the adduct with the high-consistency material and the low-viscosity liquid is increased.

When the metal that forms the adduct with the acidic phosphate ester is at least one metal selected from the group consisting of an alkali metals, an alkaline earth metals, aluminum, titanium, and zinc, adhesiveness of the liquid composition when being applied to a metal surface increases.

When the adduct containing the acidic phosphate ester and the metal has a molecular weight of 3000 or lower, the compatibility of the adduct with the high-consistency material and the low-viscosity liquid is increased.

When the liquid composition has a pH of four or higher, the composition can have excellent ionic bonding property to a transition metal. In addition, the metal surface can be prevented from being corroded by the acidic phosphate ester. Accordingly, adhesiveness and corrosion protection performance of the liquid composition when being applied to a metal surface increase.

Since in the terminal-fitted electric wire according to the present application, the electric connecting section between the terminal metal fitting and the electric wire conductor is covered with the high-consistency film, which contains the high-consistency material and the adduct containing the acidic phosphate ester and the metal, the high-consistency material and the adduct contained in the above-described liquid composition, the covered electric wire exhibits corrosion resistance that is stable over a long period of time.

DESCRIPTION OF EMBODIMENTS

Figure 1:
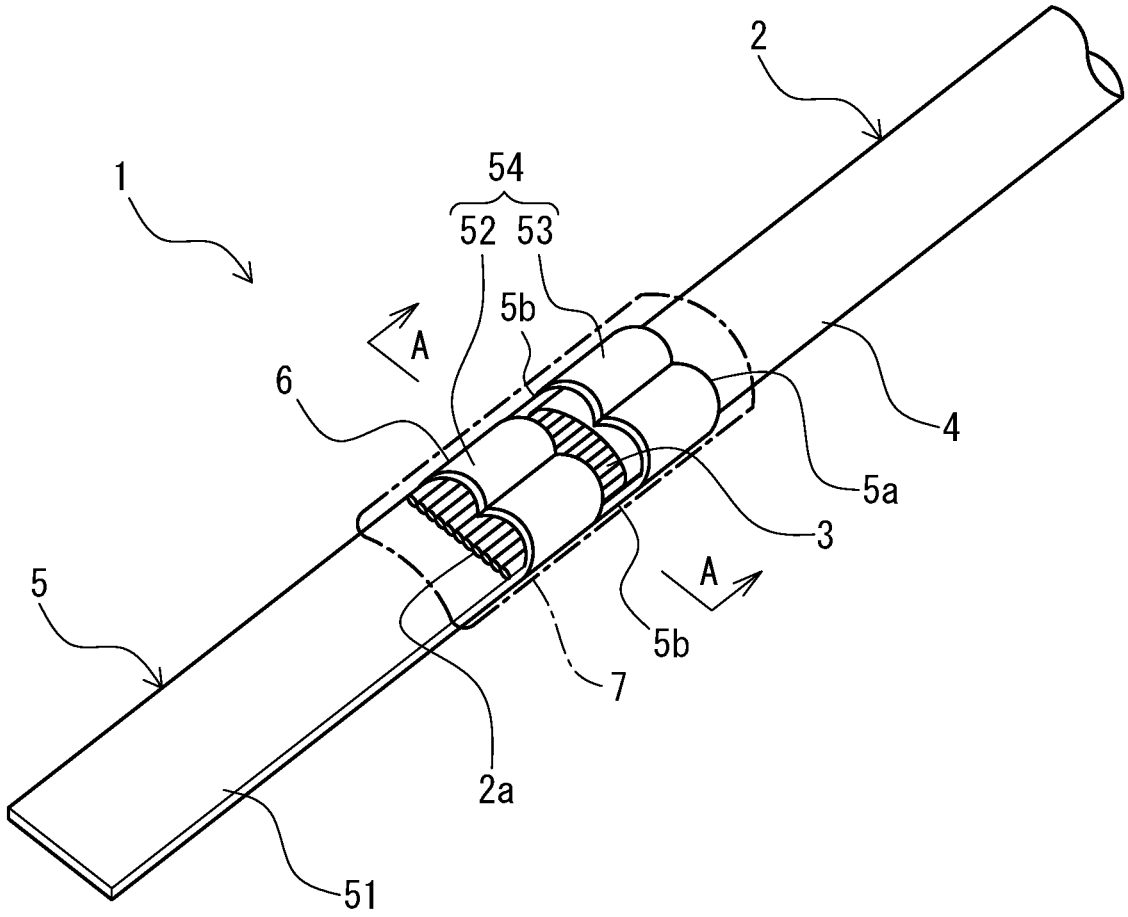
FIG. 1 is a perspective view of a terminal-fitted electric wire according to one embodiment of the present application.

Next, a detailed description of one embodiment of the present application will be provided.

The liquid composition according to the present application (hereinafter, referred to also as the present liquid composition) contains a high-consistency material, a low-viscosity liquid having a kinetic viscosity of 100 $mm^2/s$ or lower measured at 40° C. in accordance with JIS K2283, an adduct containing an acidic phosphate ester containing one or more kinds of compounds represented by General Formulae (1) and (2), and a metal, $$P(=O)(-OR_1)(-OH)_2 \quad (1)$$

$$P(=O)(-OR_1)_2(-OH) \quad (2),$$

where $R_1$ represents a hydrocarbon group having 4 to 30 carbon atoms.

The high-consistency material comprises a base oil and a hydrogen-bonding material added to the base oil. In other words, the high-consistency material is prepared by adding the hydrogen-bonding material to the base oil. The hydrogen-bonding material added to the base oil forms a network structure by hydrogen bonding in the base oil, thereby providing consistency to the base oil. The high-consistency material is, due to its consistency, retained on a surface of the material to be coated at room temperature or under heating. Examples of the high-consistency material contain a grease prepared by adding a thickening agent to the base oil. As the grease, a various kinds of grease can be used.

Examples of the base oil include those used in various kinds of grease. As the base oil, a base oil having fluidity at room temperature or high temperature may be used. The base oil has fluidity preferably within a temperature range of 20 to 200° C., and more preferably within a range of 30 to 150° C. Accordingly, the composition can be easily made into a liquid state, achieving an excellent coating property and adherence.

Specific examples of the base oil includes alkylbenzene, alkyl naphthalene, polybutene, mineral oil, synthetic oil, Vaseline, wax, synthetic ester, oils and fats, silicone oil, polyglycol, normal paraffin, isoparaffin, polyether, and a blend oil including two or more kinds of the aforementioned oil. Among these examples of the base oil, it is preferable to use the mineral oil or paraffin oil from the view point of heat stability.

The thickening agent forms a network structure by hydrogen bonding in the base oil. The base oil is retained in the network structure through adsorption phenomenon, capillary phenomenon, and the like. Accordingly, the base oil gains consistency. Examples of the thickening agent include a metal soap type and a non-soap type. Examples of the non-soap type include a urea type, an amide type and a bentonite type. Examples of the metal contained in the metal soap type include calcium, sodium, lithium, and aluminum. Since the metal soap type has less heat resistance, it is preferable to use the non-soap type from the viewpoint that it is less likely to flow out and has excellent durability when being used in an environment where heat is applied. Among the non-soap type, it is particularly preferable to use the urea type or the amide type from the viewpoint of superior heat resistance.

The consistency of the high-consistency material is preferably 50 or higher, and more preferably 85 or higher, from the viewpoint of fluidity at room temperature after application. Additionally, from the viewpoint of flexibility at room temperature after application, the consistency is preferably 475 or lower, and more preferably 450 or lower. The consistency of the high-consistency material can be measured in accordance with JIS K2220. The consistency of the high-consistency material is measured at 25° C.

The low-viscosity liquid is used to provide fluidity to the high-consistency material at room temperature. The kinetic viscosity of the low-viscosity liquid at 40° C. is 100 $mm^2/s$ or lower. The kinetic viscosity is measured in accordance with JIS K2283. It is more preferable that the kinetic viscosity of the low-viscosity liquid at 40° C. be 80 $mm^2/s$ or lower. From the viewpoint of the fluidity at room temperature before application, the kinetic viscosity of the low-viscosity liquid at 40° C. is preferably 0.05 $mm^2/s$ or higher and more preferably 0.1 $mm^2/s$ or higher.

It is preferable that the low-viscosity liquid be a volatile low-viscosity liquid having volatility. By adopting the low-viscosity liquid having volatility, it becomes easier to remove the low-viscosity liquid from the present liquid composition applied to a material to be coated and form, on a surface of the material to be coated, a high-consistency film which contains the high-consistency material and the adduct containing the acidic phosphate ester and the metal. Examples of the low-viscosity liquid include a hydrocarbon organic solvent, an ester organic solvent, an ether organic solvent, a ketone organic solvent, a halogenated hydrocarbon organic solvent, and a volatile oil. As the low-viscosity liquid, one kind of these solvents may be used alone or two or more kinds may be used in combination.

From the viewpoint of having excellent volatility and the like, it is preferable that the organic solvent such as the hydrocarbon organic solvent have carbon atoms of 30 or less, more preferably 20 or less, and further preferably 10 or less. Additionally, the boiling point of the solvent is preferably 250° C. or lower. Furthermore, from the viewpoint that the solvent exhibits stability in a liquid state at room temperature, the number of carbon atoms is preferably 5 or more, and more preferably 6 or more. The boiling point is preferably 80° C. or higher.

Examples of the volatile oil include a hydrocarbon oil having a specific gravity of less than 0.8017 at 15° C. and a flash point of −10° C. or higher and lower than 200° C. More preferably, the volatile oil is a hydrocarbon oil having a flash point of 21° C. or higher and lower than 150° C. Examples of the volatile oil include a machining oil (a cutting oil, a punching oil, and a lubrication oil).

From the viewpoint of exhibiting excellent fluidity at room temperature resulting in an excellent coating property at room temperature, the content of the low-viscosity liquid is preferably 10 mass % or more, more preferably 20 mass % or more, and further preferably 30 mass % or more. Furthermore, to secure the amount of ingredients to be retained on a surface to be coated after application and drying, the content of the low-viscosity liquid is preferably 90 mass % or less, more preferably 80 mass % or less, and further preferably 70 mass % or less.

Examples of the acidic phosphoric acid ester in the adduct containing the acidic phosphate ester and the metal include an acidic phosphoric acid ester containing only a compound represented by General Formula (1), an acidic phosphoric acid ester containing only a compound represented by General Formula (2), and an acidic phosphoric acid ester containing both of a compound represented by General Formula (1) and a compound represented by General Formula (2).

The adduct containing the acidic phosphate ester and the metal include an adduct containing only the compound represented by General Formula (1) and the metal, an adduct containing only the compound represented by General Formula (2) and the metal, and an adduct containing both of the adduct containing the compound represented by General Formula (1) and the metal and the adduct containing the compound represented by General Formula (2) and the metal.

The adduct containing the acidic phosphate ester and the metal acts as a compatibilizer which improves the compatibility of the high-consistency material and the low-viscosity liquid and improves dispersibility of the high-consistency material in the low-viscosity liquid. A long-chain alkyl group represented by $R_1$ in the acidic phosphate ester has excellent affinity with the low-viscosity liquid, thus increasing the compatibility with the low-viscosity liquid. Therefore, it is preferable that the low-viscosity liquid be an organic solvent having an organic group. From the viewpoint of the compatibility with the low-viscosity liquid, the long-chain alkyl group represented by $R_1$ in the acidic phosphate ester should preferably have a large number of carbon atoms and the number of carbon atoms should be at least four. A phosphate group (P—O-group) in the acidic phosphate ester has hydrogen-bonding property, and thus forms hydrogen bonds with the hydrogen-bonding material in the high-consistency material, suppressing formation of a network structure by the hydrogen-bonding material in the base oil. This effect is particularly well achieved with the hydrogen-bonding material having a cationic network (cohesive) portion such as a urea group and an amide group.

Further, the phosphate group (P—O-group) in the adduct containing the acidic phosphate ester and the metal is ionically bonded to a surface of a material to be coated, and contributes to making a coating film which contains the high-consistency material and the adduct containing the acidic phosphate ester and the metal adhere strongly to the surface. By containing the metal, the adduct improves ionic bonding property of the phosphate group (P—O-group) and promotes the ionic bonding. In addition, by containing the metal, the adduct has adherence. Further, by containing the metal, the adduct decreases the acidity (increases the pH) of the acidic phosphate ester to prevent the metal surface coated with the adduct from being corroded by the acidic phosphate ester.

As the metal that forms the adduct with the acidic phosphate ester, divalent or higher-valent metals are preferred from the viewpoint of having heat resistance.

Examples of the metal that forms the adduct with the acidic phosphate ester include alkali metals such as Li, Na, and K, alkaline earth metals such as Mg and Ca, aluminum, titanium, and zinc. One kind of these metals may be used alone or two or more kinds may be used in combination. Phosphate ester salts of these metals have excellent adsorption properties to the metal surface. In addition, the metals have an ionization tendency higher than Sn, and thus have excellent ionic bonding properties to Sn. Among the metals, Ca and Mg are preferred from the viewpoint of water resistance.

In the adduct containing the acidic phosphate ester and the metal, $R_1$ in the ester moiety represents a hydrocarbon group having 4 to 30 carbon atoms. $R_1$ contributes to compatibility with the base oil and the organic solvent that are long-chain alkyl compounds. The hydrocarbon group is an organic group composed of carbon and hydrogen, and does not contain a hetero element such as N, O, and S. An aliphatic hydrocarbon group and an alicyclic hydrocarbon group are preferred as $R_1$ from the viewpoint of compatibility with the base oil and the organic solvent that are long-chain alkyl compounds. Among them, the aliphatic hydrocarbon group is preferred.

Examples of the aliphatic hydrocarbon group include an alkyl group composed of saturated hydrocarbon and an alkenyl group composed of unsaturated hydrocarbon. The aliphatic hydrocarbon group may be either of them. The alkyl group or the alkenyl group that is an aliphatic hydrocarbon group may have a straight chain structure or a branched chain structure. If the alkyl group is a straight chain alkyl group such as an n-butyl group and an n-octyl group, alkyl groups are easily oriented with each other to increase the crystallinity of the adduct containing the acidic phosphate ester and the metal, so that the compatibility of the adduct with the base oil and the organic solvent is likely to decrease. From this point of view, when an alkyl group is used as $R_1$, a branched chain alkyl group is preferably used rather than a straight chain alkyl group. Meanwhile, by having one or more carbon-carbon double bond structures, an alkenyl group is not high in crystallinity even if it is a straight chain alkenyl group, so that the alkenyl group may be a straight chain alkenyl group or a branched chain alkenyl group.

$R_1$ has 4 to 30 carbon atoms. An acidic phosphate ester in which $R_1$ has less than four carbon atoms has an inorganic nature, and is very likely to be crystallized. Thus, the compatibility with the base oil and the organic solvent is not good, and the acidic phosphate ester is not mixed with the base oil and the organic solvent. Meanwhile, the acidic phosphate ester in which $R_1$ has more than 30 carbon atoms is too high in viscosity, and is difficult to secure fluidity. From the viewpoint of compatibility with the base oil and the organic solvent, $R_1$ preferably has five or more carbon atoms, and more preferably has six or more carbon atoms. From the viewpoint of fluidity, $R_1$ preferably has 26 or less carbon atoms, and more preferably has 22 or less carbon atoms.

The adduct containing the acidic phosphate ester and the metal has both a phosphate group (polar group) and a nonpolar group (a hydrocarbon group in an ester moiety) in a molecule. The adduct can be present in a layered state in which the polar groups are associated with each other while the nonpolar groups are associated with each other, so the adduct can be made to be highly viscous liquid even though the adduct is a non-polymerized compound. When applied on the metal surface, the present composition that is viscous liquid can be brought into more intimate contact with the metal surface by physical adsorption by van der Waals' forces. The viscosity is assumed to be obtained by entanglement among the molecular chains. Thus, from this point of view, the acidic phosphate ester is preferably designed not to have its crystallinity promoted. Specific examples of the design include adopting a hydrocarbon chain having 4 to 30 carbon atoms, adopting one or more branched chain structures or one or more carbon-carbon double bond structure.

The acidic phosphate ester needs to be contained in an adduct together with the metal from the viewpoint of adherence. When using an acidic phosphate ester itself, which is not contained in an adduct together with a metal, the polarity of the phosphate group is small, and the phosphate groups that define polar groups are low in associative properties (cohesive properties), and thus liquid having high viscosity can not be obtained. For this reason, the adherence (viscosity) of the adduct is low. In addition, even when the acidic phosphate ester is contained in an adduct together with ammonia or amine, the polarity of the phosphate group (amine salt) is small, and the phosphate groups (amine salts) that define polar groups are low in associative properties (cohesive properties), and thus liquid having high viscosity cannot be obtained. For this reason, the adherence (viscosity) of the adduct is low.

Specific examples of $R_1$ include an oleyl group, a stearyl group, an isostearyl group, a 2-ethylhexyl group, a butyloctyl group, an isomyristyl group, an isocetyl group, a hexyldecyl group, an octyldecyl group, an octyldodecyl group, and an isobehenyl group. The types of $R_1$ may be same between the compound represented by General Formula (1) and the compound represented by General Formula (2), or may be different. From the viewpoint of easy preparation of the present composition, the types of $R_1$ are preferably same between the compound represented by General Formula (1) and the compound represented by General Formula (2).

Specific examples of the acidic phosphate ester include butyloctyl acid phosphate, isomyristyl acid phosphate, isocetyl acid phosphate, hexyl decyl acid phosphate, isostearyl acid phosphate, isobehenyl acid phosphate, octyl decyl acid phosphate, octyl dodecyl acid phosphate, isobutyl acid phosphate, 2-ethylhexyl acid phosphate, isodecyl acid phosphate, lauryl acid phosphate, tridecyl acid phosphate, stearyl acid phosphate, oleyl acid phosphate, myristyl acid phosphate, palmityl acid phosphate, dibutyloctyl acid phosphate, di-isomyristyl acid phosphate, di-isocetyl acid phosphate, di-hexyl decyl acid phosphate, di-isostearyl acid phosphate, di-isobehenyl acid phosphate, di-octyl decyl acid phosphate, di-octyl dodecyl acid phosphate, di-isobutyl acid phosphate, di-2-ethylhexyl acid phosphate, di-isodecyl acid phosphate, di-tridecyl acid phosphate, di-oleyl acid phosphate, di-myristyl acid phosphate, and di-palmityl acid phosphate. Among them, the oleyl acid phosphate, and the isostearyl acid phosphate are preferred from the viewpoint of non-crystallinity and molecular chain entanglement with the base oil and the organic solvent.

Since the adduct containing the acidic phosphate ester and the metal increases its compatibility with the high-consistency material and the low-viscosity liquid due to microdispersion, the molecular weight of the adduct is preferably 3000 or lower, and more preferably 2500 or lower. From the viewpoint of suppressing separation of the polar groups by increase in the concentration level, the molecular weight is preferably 80 or more, and more preferably 100 or more. The molecular weight can be obtained by calculation. The molecular weight (weight-average molecular weight) of IS-SA-Ca described below is measured by GPC.

The ratio of the high-consistency material and the adduct containing the acidic phosphate ester and the metal is preferably within a range of 98:2 to 30:70, and more preferably 95:5 to 40:60. If the ratio of the high-consistency material is more than 98 parts by mass, the fluidity of the composition at room temperature decreases. If the ratio of the high-consistency material is less than 30 parts by mass, the consistency of the high-consistency film after application decreases.

The present liquid composition may partially contain an acidic phosphate ester itself, which is not contained in an adduct together with a metal, only if containing an adduct containing the specific acidic phosphate ester and the metal. However, in the present liquid composition, when the ratio of the acidic phosphate ester itself increases, the ionic bonding property of the composition is lowered, the adherence (viscosity) of the composition is lowered, and the effect of preventing corrosion is decreased. For these reasons, the ratio of the acidic phosphate ester itself is preferably lower.

Examples of an index for measuring the ratio of the acidic phosphate ester itself includes measuring the pH of the present liquid composition. When the ratio of the acidic phosphate ester increases, the amount of the residual phosphate group (P—OH group) increases, and the acidity becomes higher (the pH decreases). When the ratio of the acidic phosphate ester decreases, the amount of the residual phosphate group (P—OH group) decreases, and the acidity becomes lower (the pH increases). The pH of the present liquid composition is preferably four or higher, and more preferably 5.5 or higher.

In addition, the ratio (molar ratio) of the acidic phosphate ester and the metal can be indicated by the value of f when assuming that $f=1\times x-m\times y$, where the valency of the acidic phosphate ester is $x^-$, the valency of the metal is $y^+$, the molar amount of the acidic phosphate ester is 1, and the molar amount of the metal is m. Within the range $f>0$, the acidic phosphate ester is in excess of the metal, and the phosphate group (P—OH group) remains. When $f=0$, the acidic phosphate ester is equimolar to the metal, and no phosphate group (P—OH group) remains. In addition, when $f<0$, the acidic phosphate ester is insufficient for the metal, and no phosphate group (P—OH group) remains. In order to increase the pH of the present liquid composition, it is preferable that $f<0$.

A stabilizing agent, an anticorrosive agent, a pigment, a viscosity enhancing agent, a filler, and the like can be added to the present liquid composition in addition to the high-consistency material, the low-viscosity liquid, and the adduct containing the acidic phosphate ester and the metal within a range of not impairing the functions of the present liquid composition.

The present liquid composition can be obtained by mixing the high-consistency material, the low-viscosity liquid, the adduct containing the acidic phosphate ester and the metal, and ingredients to be added as necessary. The adduct containing the acidic phosphate ester and the metal makes the high-consistency material compatibilize with the low-viscosity liquid, increasing dispersibility of the high-consistency material in the low-viscosity liquid. Consequently, the present liquid composition having excellent fluidity at room temperature is obtained, and thus has an excellent coating property at room temperature. Furthermore, by removal of the low-viscosity liquid from the present liquid composition by a method such as volatilization after application, a high-consistency film containing the high-consistency material and the adduct containing the acidic phosphate ester and the metal is formed. Accordingly, consistency of the high-consistency material is recovered and the original property (consistency) of the high-consistency material is exhibited. That is, the consistency of the high-consistency material keeps the high-consistency film retained on a surface to be coated after application. In this process, the adduct containing the acidic phosphate ester and the metal acts as a metallic adsorbate and contributes to improving adherence of the high-consistency film to a metal surface. The present liquid composition can be deposited on a surface of a material to be coated by applying the present liquid composition on the surface of the material to be coated or immersing the material to be coated in the present liquid composition.

The film thickness of the high-consistency film applied on the surface of the material to be coated is preferably 100 μm or less, and more preferably 50 μm or less from the viewpoint of preventing the present On the other hand, the film thickness is preferably a given thickness or more from the viewpoint of the mechanical strength of the high-consistency film to be formed. Examples of the lower limit of the film thickness include 0.5 μm, 2 μm, and 5 μm.

The present liquid composition can be used for the purpose of lubrication or corrosion protection. Examples of the use for corrosion protection include the use as an anticorrosive agent for a terminal-fitted electric wire.

Next, a description of a terminal-fitted electric wire according to the present application will be provided.

The terminal-fitted electric wire according to the present application contains a terminal metal fitting and an insulated electric wire, the terminal metal fitting being connected to the end of a conductor of the insulated electric wire, where an electric connecting section between the terminal metal fitting and the electric wire conductor is covered with a high-consistency film containing the high-consistency material and the adduct containing the acidic phosphate ester and the metal made of the present liquid composition. Thus, the electric connecting section can be prevented from being corroded.

Figure 2:
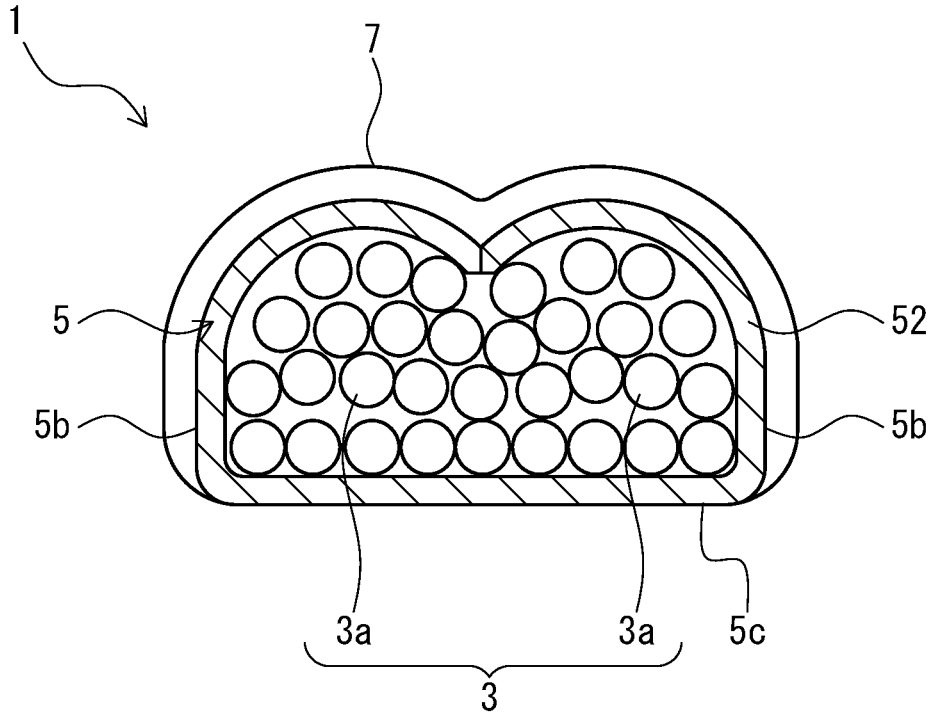
FIG. 2 is a longitudinal sectional view of the terminal-fitted electric wire taken along the line A-A of FIG. 1.

FIG. 1 is a perspective view of a terminal-fitted electric wire according to one embodiment of the present application. FIG. 2 is a longitudinal sectional view of the terminal-fitted electric wire taken along the line A-A of FIG. 1. As shown in FIGS. 1 and 2, a terminal-fitted electric wire 1 has a configuration that electric wire conductors 3 of a covered electric wire 2 that is covered with an insulating covering (an insulator) 4 are electrically connected to a terminal metal fitting 5 by an electric connecting section 6.

The terminal metal fitting 5 contains a tab-like connecting portion 51 made of a long and thin flat plate that is to be connected to a counterpart terminal, and a wire fixing portion 54 that contains a wire barrel 52 and an insulation barrel 53 extending and provided to an end portion of the connecting portion 51. The terminal metal fitting 5 can be formed (manufactured) to have a predetermined shape by pressing of a metal plate.

The electric wire conductors 3 are exposed at the electric connecting section 6 by stripping off the insulating covering 4 at the end of the covered electric wire 2, and the exposed electric wire conductors 3 are crimped onto one surface of the terminal metal fitting 5, whereby the covered electric wire 2 is connected to the terminal metal fitting 5. The wire barrel 52 of the terminal metal fitting 5 is swaged on the electric wire conductors 3 of the covered electric wire 2, whereby the electric wire conductors 3 are electrically connected to the terminal metal fitting 5. In addition, the insulation barrel 53 of the terminal metal fitting 5 is swaged on the insulating covering 4 of the covered electric wire 2.

In the terminal-fitted electric wire 1, the region indicated with the dashed line is covered with a high-consistency film 7 made of the present liquid composition. To be specific, the region ranging from the top surface of the terminal metal fitting 5 at a portion that is more in front than the distal end of the exposed portion of the electric wire conductors 3 that is exposed from the insulating covering 4 to the top surface of the insulating covering 4 at a portion that is more behind than the rear end of the exposed portion of the electric wire conductors 3 that is exposed from the insulating covering 4 is covered with the high-consistency film 7. That is, the covered electric wire 2 is covered with the high-consistency film 7 such that on the side of a distal end 2*a*, the high-consistency film 7 slightly extends off toward the connecting portion 51 of the terminal metal fitting 5 from the distal end of the electric wire conductors 3. The terminal metal fitting 5 is covered with the high-consistency film 7 such that on the side of a distal end 5*a*, the high-consistency film 7 slightly extends off toward the insulating covering 4 of the covered electric wire 2 from the end portion of the insulation barrel 53. As shown in FIG. 2, side surfaces 5*b* of the terminal metal fitting 5 are also covered with the high-consistency film 7. It is to be noted that a back surface 5*c* of the terminal metal fitting 5 may not be covered with the high-consistency film 7 or may be covered with the high-consistency film 7. The circumferential end of the high-consistency film 7 includes a portion being in contact with the surface of the terminal metal fitting 5, a portion being in contact with the surface of the electric wire conductors 3, and a portion being in contact with the surface of the insulating covering 4.

Thus, the electric connecting section 6 is covered with the high-consistency film 7 of a predetermined thickness along the shape of the outer circumference of the terminal metal fitting 5 and the covered electric wire 2. Consequently, the exposed portion of the electric wire conductors 3 of the covered electric wire 2 is completely covered with the high-consistency film 7, and is not exposed to the outside. Thus, the electric connecting section 6 is completely covered with the high-consistency film 7. The high-consistency film 7 has excellent adhesiveness with all of the electric wire conductors 3, the insulating covering 4, and the terminal metal fitting 5, so that the high-consistency film 7 prevents water or the like from getting into the electric wire conductors 3 and the electric connecting section 6 from the outside to corrode the metal portions. In addition, since the high-consistency film 7 has excellent adhesiveness, even when the electric wire is bent, for example, during the process of manufacturing a wire harness to attaching the wire harness to a vehicle, clearance is hardly created any of between the high-consistency film 7 and the electric wire conductors 3, between the high-consistency film 7 and the insulating covering 4, and between the high-consistency film 7 and the terminal metal fitting 5 at the circumferential end of the high-consistency film 7, and thus the waterproof property and the anticorrosion function can be maintained.

The present liquid composition for forming the high-consistency film 7 is applied in a predetermined area. Known means such as an instillation method and a coating method can be used for applying the present liquid composition for forming the high-consistency film 7. The present liquid composition is applied under room temperature since the present liquid composition has excellent fluidity at room temperature.

The high-consistency film 7 of a predetermined thickness is applied in the predetermined area. The thickness is preferably within the range of 0.01 to 0.1 mm. When the high-consistency film 7 is too thick, the terminal metal fitting 5 can not be easily inserted into a connector. When the high-consistency film 7 is too thin, the corrosion protection performance is likely to decrease.

The electric wire conductors 3 of the covered electric wire 2 consists of a strand made by stranding a plurality of elemental wires 3*a*. The strand may consist of one kind of metal elemental wires, or may consist of two or more kinds of metal elemental wires. In addition, the strand may contain elemental wires made of organic fibers in addition to the metal elemental wires. It is to be noted that consisting of one kind of metal elemental wires defines consisting of metal elemental wires all of which, constituting the strand, are made from a same metal material, and consisting of two or more kinds of metal elemental wires defines consisting of metal elemental wires including metal elemental wires made from different metal materials in the strand. The strand may contain a reinforcing wire (tension member) or the like for reinforcing the covered electric wire 2.

Examples of the material for the metal elemental wires constituting the electric wire conductors 3 include copper, a copper alloy, aluminum, an aluminum alloy, and materials prepared by subjecting the above-described materials to a variety of plating. Examples of the material for the metal elemental wire as a reinforcing wire include a copper alloy, titanium, tungsten, and stainless steel. Examples of the material for the organic fiber as a reinforcing wire include Kevlar. As the material for the metal elemental wires constituting the electric wire conductors 3, aluminum, an aluminum alloy, and materials prepared by subjecting these materials to a variety of plating are preferred from the viewpoint of weight reduction.

Examples of the material for the insulating covering 4 include rubber, polyolefin, PVC, and a thermoplastic elastomer. These materials may be used alone or two or more kinds may be used in combination. A variety of additives may be added to the material for the insulating covering 4 as appropriate. Examples of the additives include a flame retardant, a filler, and a coloring agent.

Examples of the material for the terminal metal fitting 5 (the material for the base material) include commonly used brass, various kinds of copper alloys, and copper. A part of the surface of the terminal metal fitting 5 (e.g., a contact point) or the entire surface may be plated with various kinds of metals such as tin, nickel, and gold.

It is to be noted that while in the terminal-fitted electric wire 1 shown in FIG. 1, the terminal metal fitting is connected to the end of the electric wire conductors by a crimp connection method, the terminal metal fitting may be connected to the end of the electric wire conductors by a known electric connection method instead of the crimp connection method.

EXAMPLES

Hereinafter, a description will be provided with reference to examples; however, the present invention is not limited to the examples.

Synthesis of the Adduct Containing an Acidic Phosphate Ester and a Metal

Synthesis Example 1: OL-Li 50 g (acid value of 0.163 mol) of oleyl acid phosphate ("Phoslex A18D" manufactured by SC ORGANIC CHEMICAL CO., LTD., molecular mass of 467 (average), acid value of 183 mg KOH/g) and 50 mL of methanol were placed in a 500 mL flask, and were stirred at 50° C. to yield a uniform solution. A solution obtained by dissolving 6.84 g (0.163 mol) of lithium hydroxide monohydrate in 50 mL of methanol was gradually added thereto. The resulting clear solution was stirred for 30 minutes while keeping the temperature at 50° C., and then the methanol and the generated water were distilled off under reduced pressure using a rotary evaporator. Then, after the addition of 50 mL of toluene, the mixture was distilled in the same manner to distill the generated water off by azeotropy, and then the product of interest that was a clear viscous substance was obtained.

Synthesis Example 2: OL-Ca 50 g (acid value of 0.163 mol) of oleyl acid phosphate ("Phoslex A18D" manufactured by SC ORGANIC CHEMICAL CO., LTD., molecular mass of 467 (average), acid value of 183 mg KOH/g) and 50 mL of methanol were placed in a 500 mL flask, and were stirred at room temperature to yield a uniform solution. 6.04 g (0.0815 mol) of calcium hydroxide was added thereto, and the resulting suspension was stirred for 24 hours while being kept at room temperature. After it was confirmed that a deposition of the calcium hydroxide disappeared, the mixture was filtered, and then the methanol and the generated water were distilled off under reduced pressure using a rotary evaporator. Then, after the addition of 50 mL of toluene, the mixture was distilled in the same manner to distill the generated water off by azeotropy, and then the product of interest that was a clear viscous substance was obtained.

Synthesis Example 3: IS—Li

The product of interest that was a clear viscous substance was obtained in the same manner as in Synthesis Example 1, except that 50 g (acid value of 0.159 mol) of isostearyl acid phosphate ("Phoslex A18OL" manufactured by SC ORGANIC CHEMICAL CO., LTD., molecular mass of 487 (average), acid value of 178 mg KOH/g) was used instead of oleyl acid phosphate, and 6.67 g (0.159 mol) of lithium hydroxide monohydrate was added thereto.

Synthesis Example 4: IS—Ca

The product of interest that was a clear viscous substance was obtained in the same manner as in Synthesis Example 2, except that 50 g (acid value of 0.159 mol) of isostearyl acid phosphate ("Phoslex A18OL" manufactured by SC ORGANIC CHEMICAL CO., LTD., molecular mass of 487 (average), acid value of 178 mg KOH/g) was used instead of oleyl acid phosphate, and 5.89 g (0.0795 mol) of calcium hydroxide was added thereto.

Synthesis Example 5: IS—Mg

The product of interest that was a clear viscous substance was obtained in the same manner as in Synthesis Example 4, except that 4.64 g (0.0795 mol) of magnesium hydroxide was added thereto instead of 5.89 g (0.0795 mol) of calcium hydroxide.

Synthesis Example 6: IS—Zn

The product of interest that was a clear viscous substance was obtained in the same manner as in Synthesis Example 4, except that 8.73 g (0.0795 mol as Zn) of basic zinc carbonate was added thereto instead of 5.89 g (0.0795 mol) of calcium hydroxide.

Synthesis Example 7: IS—Al

The product of interest that was a clear viscous substance was obtained in the same manner as in Synthesis Example 3, except that 10.83 g (0.053 mol) of aluminum isopropoxide was added thereto instead of the lithium hydroxide monohydrate anhydrous/methanol solution.

Synthesis Example 8: EH-Ca

The product of interest that was a clear viscous substance was obtained in the same manner as in Synthesis Example 4, except that 50 g (acid value of 0.153 mol) of di-2-ethylhexyl acid phosphate ("Phoslex A-208" manufactured by SC ORGANIC CHEMICAL CO., LTD., molecular mass of 322 (average), acid value of 172 mg KOH/g) was used instead of isostearyl acid phosphate, and 5.67 g (0.076 mol) of calcium hydroxide was added thereto.

Synthesis Example 9: IS-SA-Ca 100 g (acid value of 0.317 mol) of isostearyl acid phosphate ("Phoslex A18OL" manufactured by SC ORGANIC CHEMICAL CO., LTD., molecular mass of 487 (average), acid value of 178 mg KOH/g) and 116 g (ultrabasic Ca mass 6.4 g=0.159 mol) of ultrabasic alkyl salicylate calcium salt (Ca content 8.0 mass %, ultrabasic Ca content 5.5 mass %) were placed in a 500 mL flask, and were stirred at 120° C. for three hours. After it was confirmed that carbon dioxide gas is no longer generated, the flask was cooled to room temperature and then the product of interest that was a brown viscous substance was obtained.

Synthesis Example 10: MT-Li

The product of interest was obtained in the same manner as in Synthesis Example 1, except that 25 g (acid value of 0.315 mol) of methyl acid phosphate ("Phoslex A-1" manufactured by SC ORGANIC CHEMICAL CO., LTD., molecular mass of 119 (average), acid value of 707 mg KOH/g) was used instead of oleyl acid phosphate, and 13.2 g (0.315 mol) of lithium hydroxide monohydrate was added thereto.

Synthesis Example 11: MT-Ca

The product of interest was obtained in the same manner as in Synthesis Example 2, except that 25 g (acid value of 0.315 mol) of methyl acid phosphate ("Phoslex A-1" manufactured by SC ORGANIC CHEMICAL CO., LTD., molecular mass of 119 (average), acid value of 707 mg KOH/g) was used instead of oleyl acid phosphate, and 11.67 g (0.157 mol) of calcium hydroxide was added thereto.

(Measurement of pH of the Adduct Containing an Acidic Phosphate Ester and a Metal)

Each adduct was suspended in pure water in a proportion of about 3% (w/v) by ultrasonic irradiation, and the pH of the suspension was measured using a pH meter equipped with a glass electrode.

(Measurement of Molecular Weight of the Adduct Containing an Acidic Phosphate Ester and a Metal)

The molecular weight was obtained by calculation. The molecular weight (weight-average molecular weight) of IS-SA-Ca was measured by GPC. (Solvent: Chloroform, column: TSKgel G2500H x L (TOSOH CORPORATION))

(Preparation of the Present Liquid Composition)

The present liquid composition was prepared by mixing each adduct containing an acidic phosphate ester and a metal obtained by the Synthesis Examples 1 to 11 with the high-consistency material and the low-viscosity liquid at a predetermined ratio at room temperature.

(High-Consistency Material)

G-UR: Urea grease ("BMG-U/Boom Grease" manufactured by WAKO CHEMICAL, LTD., consistency: 265)

G-Li: Lithium soap grease ("Molycoat" manufactured by Dow Corning Toray Co., Ltd., consistency: 260)

G-Ca: Calcium soap grease ("Sumigrease Chassis) manufactured by SUMICO LUBRICANT CO., LTD., consistency: 280)

The consistency was measured at 25° C. in accordance with JIS K2220.

(Low-Viscosity Liquid)

n-hexane: kinetic viscosity: 0.37 $mm^2/s$, boiling point: 68° C.

n-dodecane: kinetic viscosity: 1.46 $mm^2/s$, boiling point: 216° C.

Butyl acetate: kinetic viscosity: 0.78 $mm^2/s$, boiling point: 126° C.

Isododecane: kinetic viscosity: 1.35 $mm^2/s$, boiling point: 177° C.

The kinetic viscosity was measured at 40° C. in accordance with JIS K2283.

(Evaluation of Fluidity at Room Temperature)

Viscosity of each liquid composition prepared was measured at room temperature in accordance with JIS Z8803. The liquid composition with viscosity of lower than 10 Pa·s was evaluated as good indicated by "G", and the liquid composition with viscosity of 10 Pa·s or higher was evaluated as bad indicated by "B".

(Evaluation of Uniform Coating Property)

At room temperature, a rectangular copper plate of 5×50×0.2 mm was immersed in each liquid composition prepared for 30 seconds. After the copper plate was removed from the liquid composition, the plate was placed horizontally in an oven at a temperature of 100° C. for 20 minutes and then was left at room temperature for two hours. Thereafter, a coated surface was visually observed. The liquid composition that was applied uniformly without unevenness was evaluated as good indicated by "G" and the liquid composition that was not applied uniformly exhibiting unevenness like corrugation was evaluated as bad indicated by "B".

(Evaluation of Retainability)

The samples that were evaluated as good in the evaluation of the uniform coating performance, were placed upright in a thermostatic chamber at 120° C. and left for 48 hours. Then, the samples were removed from the chamber and were cooled down to room temperature. Thereafter, the coated surfaces of the samples were again visually observed. The sample that retains the uniformly-applied state just like the state before the sample was placed in the thermostatic chamber, was evaluated as good indicated by "G". The sample that exhibited dripping of the composition was evaluated as bad indicated by "B".

TABLE 1

| | | pH | Mol. weight | Example 1 | 2 | 3 | 4 | 5 | 6 | 7 | 8 | 9 | 10 | 11 |
|---|---|---|---|---|---|---|---|---|---|---|---|---|---|---|
| High-consistency material | G-UR | | | 40.0 | 40.0 | 40.0 | 40.0 | 40.0 | 40.0 | 40.0 | 40.0 | 40.0 | | |
| | G-Li | | | | | | | | | | | | 40.0 | |
| | G-Ca | | | | | | | | | | | | | 40.0 |
| Low-viscosity liquid | n-hexane | | | 40.0 | 40.0 | 40.0 | 40.0 | 40.0 | 40.0 | 40.0 | 40.0 | 40.0 | 40.0 | 40.0 |
| | n-dodecane | | | | | | | | | | | | | |
| | Butyl acetate | | | | | | | | | | | | | |
| | Isododecane | | | | | | | | | | | | | |
| Adduct | OL-Li | 7.2 | 505 | 20.0 | | | | | | | | | | |
| | OL-Ca | 7.3 | 1061 | | 20.0 | | | | | | | | | |
| | IS- Li | 7.3 | 521 | | | 20.0 | | | | | | | | |
| | IS-Ca | 7.2 | 1068 | | | | 20.0 | | | | | | | |
| | IS-Mg | 7.4 | 1051 | | | | | 20.0 | | | | | | |
| | IS-Zn | 7.3 | 1092 | | | | | | 20.0 | | | | | |
| | IS-Al | 7.1 | 1567 | | | | | | | 20.0 | | | | |
| | EH-Ca | 7.2 | 595 | | | | | | | | 20.0 | | | |
| | IS-SA-Ca | 7.0 | 880 | | | | | | | | | 20.0 | 20.0 | 20.0 |
| pH of liquid composition | | | | 7.1 | 7.2 | 7.2 | 7.2 | 7.4 | 7.2 | 7.1 | 7.2 | 7.0 | 7.0 | 7.0 |
| Fluidity at RT | | | | G | G | G | G | G | G | G | G | G | G | G |
| Uniform coating property | | | | G | G | G | G | G | G | G | G | G | G | G |
| Retainability | | | | G | G | G | G | G | G | G | G | G | G | G |

| | | pH | Mol. weight | Example 12 | 13 | 14 | 15 | 16 | 17 | 18 |
|---|---|---|---|---|---|---|---|---|---|---|
| High-consistency material | G-UR | | | 40.0 | 40.0 | 40.0 | 58.8 | 18.0 | 70.0 | 6.6 |
| | G-Li | | | | | | | | | |
| | G-Ca | | | | | | | | | |
| Low-viscosity liquid | n-hexane | | | | | | | | | |
| | n-dodecane | | | 40.0 | | | | | | |
| | Butyl acetate | | | | 40.0 | | | | | |
| | Isododecane | | | | | 40.0 | 40.0 | 40.0 | 10.0 | 90.0 |
| Adduct | OL-Li | 7.2 | 505 | | | | | | | |
| | OL-Ca | 7.3 | 1061 | | | | | | | |
| | IS- Li | 7.3 | 521 | | | | | | | |
| | IS-Ca | 7.2 | 1068 | | | | | | | |
| | IS-Mg | 7.4 | 1051 | | | | | | | |
| | IS-Zn | 7.3 | 1092 | | | | | | | |
| | IS-Al | 7.1 | 1567 | | | | | | | |
| | EH-Ca | 7.2 | 595 | | | | | | | |
| | IS-SA-Ca | 7.0 | 880 | 20.0 | 20.0 | 20.0 | 1.2 | 42.0 | 20.0 | 3.4 |
| pH of liquid composition | | | | 7.0 | 7.0 | 7.0 | 7.1 | 7.0 | 7.1 | 7.0 |
| Fluidity at RT | | | | G | G | G | G | G | G | G |
| Uniform coating property | | | | G | G | G | G | G | G | G |
| Retainability | | | | G | G | G | G | G | G | G |

TABLE 2

| | | pH | Mol. weight | Comparative Example 1 | 2 | 3 | 4 | 5 | 6 | 7 |
|---|---|---|---|---|---|---|---|---|---|---|
| High-consistency material | G-UR | | | 50.0 | 50.0 | | | 40.0 | | |
| | G-Li | | | | | 50.0 | | | | |
| | G-Ca | | | | | | 50.0 | | 40.0 | |
| Low-viscosity liquid | n-hexane | | | 50.0 | | | | | | |
| | Isododecane | | | | 50.0 | 50.0 | 50.0 | 40.0 | 40.0 | 50.0 |
| Adduct | IS-SA-Ca | 7.0 | 880 | | | | | | | 50.0 |
| | MT-Li | 7.1 | 132 | | | | | 20.0 | | |
| | MT-Ca | 7.3 | 290 | | | | | | 20.0 | |
| pH of liquid composition | | | | 7.1 | 7.1 | 7.0 | 7.0 | 7.1 | 7.2 | 7.0 |
| Fluidity at RT | | | | B | B | B | B | B | B | G |
| Uniform coating property | | | | B | B | B | B | B | B | G |
| Retainability | | | | — | — | — | — | — | — | B |

As FIG. 1 shows, it was confirmed that each of the present liquid compositions of Examples 1 to 18 shows sufficient fluidity at room temperature and can be applied uniformly onto a material to be coated even at room temperature. It was confirmed that no changes are observed on the surface that was uniformly coated with the composition even after the retainability test, and the coating film maintains the consistency of the high-consistency material. That is, the coating film is formed utilizing the consistency of the high-consistency material. Furthermore, although a calcium soap grease generally has an insufficient heat resistance, it was confirmed that the high-consistency film obtained from the present liquid composition has sufficient retainability, even when the composition contains the calcium soap grease.

In each of the liquid compositions of Comparative Examples 1 to 4, mixing of the high-consistency material and the low-viscosity liquid is insufficient and thus an improvement in the fluidity at room temperature was not observed. Accordingly, the liquid composition was not able to be coated uniformly. In each of the liquid compositions of Comparative Examples 5 and 6, the adduct containing an acidic phosphate ester and a metal is contained. However, since the number of carbon atoms in the alkyl group of the phosphate ester is small and the alkyl chain is short, the adduct did not compatibilize with the low-viscosity liquid, resulting in insufficient mixing of the high-consistency material and the low-viscosity liquid. Consequently, improvement of fluidity at room temperature was not observed, and as a result the liquid composition was applied uniformly. In Comparative Example 7, since the liquid composition does not contain the high-consistency material, the liquid composition was not retained sufficiently on the surface to be coated after application. That is, a coating film can not be formed utilizing consistency of the high-consistency material.

While the embodiment has been described in detail, the present invention is not limited to the above-described embodiment, and various modifications can be made without departing from the gist of the present invention.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

The invention claimed is:

1. A liquid composition comprising:

a high-consistency material having a consistency ranging from 50 to 475 when measured at 25° C. in accordance with JIS K2220;

a volatile low-viscosity liquid having a kinetic viscosity of 100 $mm^2/s$ or lower measured at 40° C. in accordance with JIS K2283, wherein the low-viscosity liquid comprises at least one of a hydrocarbon organic solvent having carbon atoms of 30 or less, an ester organic solvent, an ether organic solvent, a ketone organic solvent, a halogenated hydrocarbon organic solvent, or a volatile oil having a specific gravity of less than 0.8017 at 15° C. and a flash point of −10° C. or higher and lower than 200° C.; and an adduct comprising:

an acidic phosphate ester comprising one or more kinds of compounds represented by General Formulae (1) and (2); and a metal, $$P(=O)(-OR_1)(-OH)_2 \quad (1)$$

$$P(=O)(-OR_1)_2(-OH) \quad (2),$$

where $R_1$ represents a hydrocarbon group having 4 to 30 carbon atoms.

2. The liquid composition according to claim 1, wherein the high-consistency material is a grease comprising:

a base oil; and a thickening agent.

3. The liquid composition according to claim 2, wherein the thickening agent is a metal soap type or a non-soap urea or bentonite type.

4. The liquid composition according to claim 1, wherein a content of the low-viscosity liquid is within a range of 10 to 90 mass %.

5. The liquid composition according to claim 1, wherein $R_1$ has one or more branched chain structures, or one or more carbon-carbon double bond structures in the structure of the hydrocarbon group having 4 to 30 carbon atoms.

6. The liquid composition according to claim 1, wherein the metal that forms the adduct with the acidic phosphate ester comprises at least one metal selected from the group consisting of alkali metals, alkaline earth metals, aluminum, titanium, and zinc.

7. The liquid composition according to claim 1, wherein the adduct comprising the acidic phosphate ester and the metal has a molecular weight of 3000 or lower.

8. The liquid composition according to claim 1, wherein a mass ratio of the high-consistency material and the adduct comprising the acidic phosphate ester and the metal is within a range of 98:2 to 30:70.

9. The liquid composition according to claim 1, having a pH of four or higher.

10. The liquid composition according to claim 1, wherein the composition forms a high-consistency film on a metal surface when applied on the surface, the film comprising:

the high-consistency material; and the adduct comprising the acidic phosphate ester and the metal.

11. The liquid composition according to claim 1, wherein the hydrocarbon organic solvent has carbon atoms of 20 or less.

12. The liquid composition according to claim 1, wherein a boiling point of the hydrocarbon organic solvent is between 80° C. and 250° C.

13. The liquid composition according to claim 1, wherein the volatile low-viscosity liquid has a kinematic viscosity of 1.46 $mm^2/s$ or lower measured at 40° C. in accordance with JIS K2283.

14. A terminal-fitted electric wire comprising an electric connecting section between a terminal metal fitting and an electric wire conductor, the electric connecting section covered with a high-consistency film comprising the liquid composition according to claim 1.

* * * * *